US005216198A

United States Patent [19]

Bourgin

[11] Patent Number: 5,216,198

[45] Date of Patent: Jun. 1, 1993

[54] EXERCISE MINE

[75] Inventor: Pascal Bourgin, Unieux, France

[73] Assignee: Giat Industries (S.A.), Versailles Cedex, France

[21] Appl. No.: 845,027

[22] Filed: Mar. 3, 1992

[30] Foreign Application Priority Data

Mar. 5, 1991 [FR] France ..... 91 02586

[51] Int. Cl.[5] ..... F42B 23/00

[52] U.S. Cl. ..... 102/401; 102/395; 102/407; 102/498

[58] Field of Search ..... 102/395, 401, 407, 425, 102/498, 529

[56] References Cited

U.S. PATENT DOCUMENTS 4,252,062 2/1981 Auge ..... 102/401
4,391,198 5/1983 Auge ..... 102/401
4,969,398 11/1990 Lundwall ..... 102/401
5,069,136 12/1991 Axelson et al. ..... 102/401

FOREIGN PATENT DOCUMENTS 3505172 8/1986 Fed. Rep. of Germany .
3714453 1/1988 Fed. Rep. of Germany .

*Primary Examiner*—Harold J. Tudor
*Attorney, Agent, or Firm*—Bacon & Thomas

[57] ABSTRACT

An exercise mine has a ballast portion, a generally barrel-shaped body constituted by a single piece molded about the ballast portion and a plurality of U-shaped metal fitting members having terminal portions that form resilient tabs which project outside the periphery of the body. The fitting members are secured together in groups to permit, along with the single molded body, the mine to be readily formed from just a few parts while ensuring the mechanical strength and durability of the mine.

2 Claims, 2 Drawing Sheets

EXERCISE MINE

The present invention relates to military training equipment and it relates more particularly to dummy mines used for exercising and training personnel, and also to equipment used for reloading, transporting, storing, and firing mines.

More specifically, the invention relates to the field of surface land mines for training purposes.

BACKGROUND OF THE INVENTION

To enable personnel to be trained in exercises of firing mines, in handling mine equipment, and in using surface land mines generally, it is common practice to use "exercise" mines which represent the shape and the mass of real mines, while not being provided with any explosive charge.

Such mines comprise a body which is generally barrel shaped about an axis of symmetry, and which is usually in the form of a body of revolution. Such a body comprises two housings made of elastomer or like material delimiting an internal cavity which is filled with ballast of dense material.

The two housings which are symmetrical about a transverse midplane perpendicular to the axis of revolution, are held together by axially-extending steel ties passing through the housings and riveted on the outside to the two transverse faces that the housings define for the body.

The rivets at the ends of the ties are taken advantage of for securing two rings external to the transverse faces and on which resilient tabs are welded that project outwardly from the periphery of the body in radial directions that alternate from one face to the other, each sloping away from a corresponding face towards the median transverse joint plane between the two housings. The function of the resilient tabs is to position the mine regardless of the nature of the terrain.

Such dummy or exercise mines provide satisfaction for the function that they are required to perform, but they suffer from a drawback relating, mainly, to their manufacturing cost given the large number of unit parts that need to be made and assembled together to make up one mine. It turns out that thirteen different unit parts need to be assembled and this undoubtedly raises the overall manufacturing cost and increases costs relating to storage, mounting, and assembly for each mine.

The object of the invention is to remedy this drawback by proposing a novel structure enabling, in particular, the cost to be reduced by reducing the number of unit parts used in making up a mine, and also, above all, by eliminating most of the assembly operations that are necessary in the prior art.

Another object of the invention is also to improve the mechanical strength, in particular of the resilient tabs, by eliminating the dangers of corrosion which are due mainly to the way in which the resilient tabs are connected to the rings that carry them in the prior art, i.e. welding.

SUMMARY OF THE INVENTION

To achieve the above objects, the exercise mine of the invention includes the improvements whereby:

the body is formed by molding a single piece over the ballast;

the tabs are formed by folded-back terminal portions of metal fittings embedded in a portion of the body that surrounds the ballast; and the ballast is formed or constituted so that its center of gravity lies on axial and transverse axes of symmetry of the body.

BRIEF DESCRIPTION OF THE DRAWINGS

An embodiment of the invention is described by way of example with reference to the accompanying drawings, in which.

DETAILED DESCRIPTION

Figure 1:
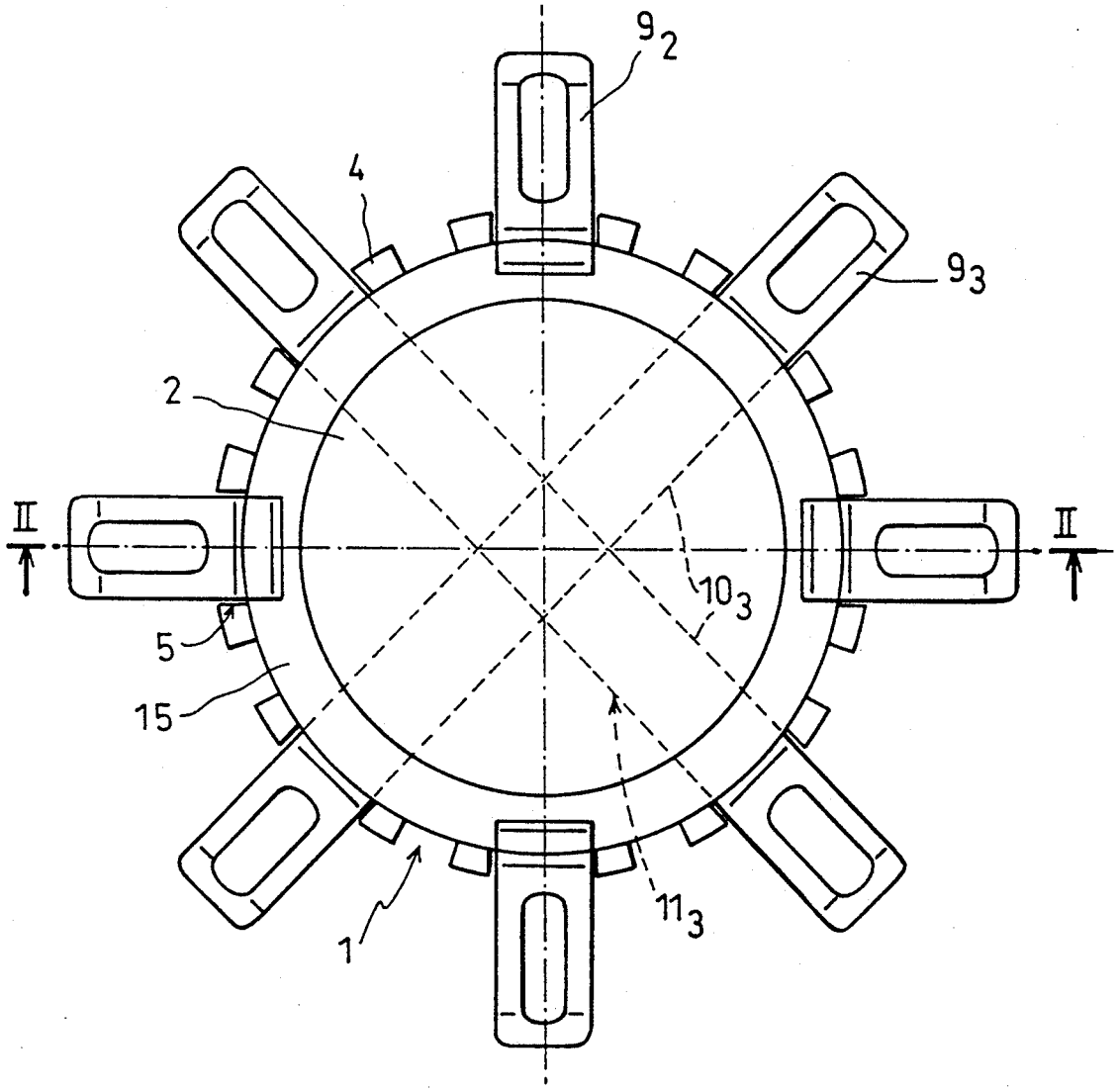
FIG. 1 is a plan view of an exercise mine of the invention.
Figure 2:
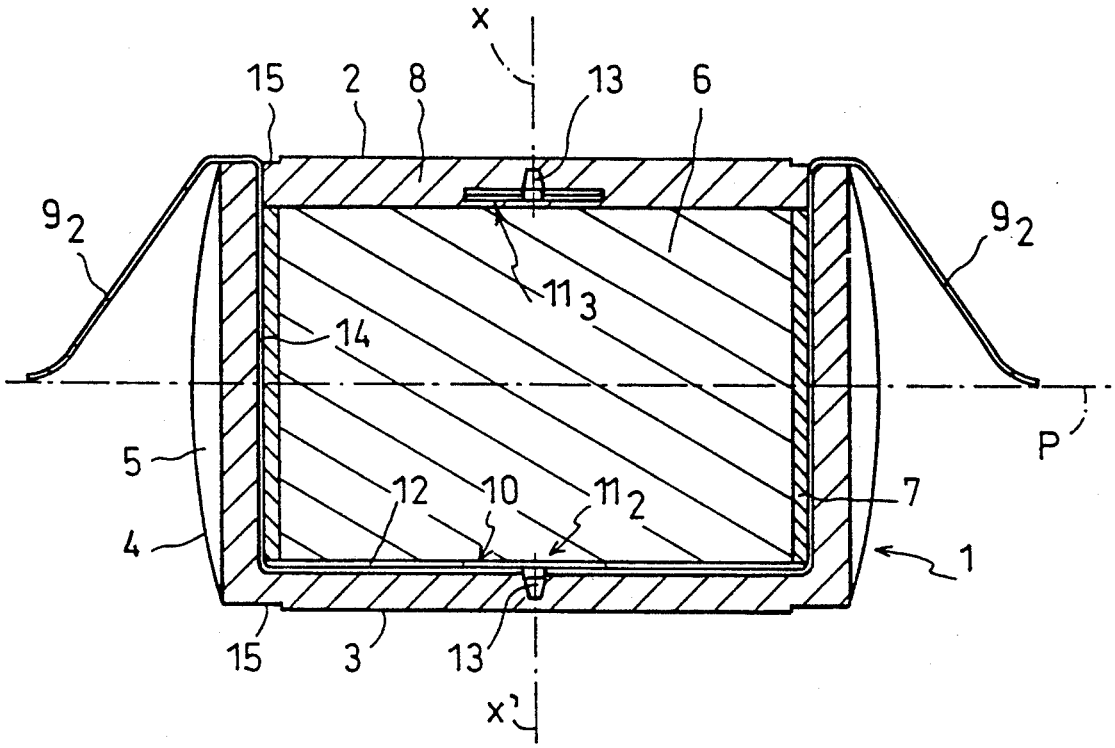
FIG. 2 is an elevation in section taken on line II—II of FIG. 1.

In the drawings, an exercise mine of the invention comprises a generally barrel-shaped body 1 having an axis of symmetry or revolution x—x'. The body 1 includes two plane transverse faces 2 and 3 that are parallel to each other and perpendicular to the axis x—x'. The transverse faces 2 and 3 delimit the body 1 in combination with a periphery 4 that may be smooth, stepped, or formed to include uniformly angularly spaced apart recesses 5 whose function is described below.

The body 1 comprises ballast 6 which may be made in various different ways providing it is cheap, has relatively high density (relative density generally in the range 2.3 to 2.5), withstands temperature well up to about 220° C., has good mechanical strength, particularly when subjected to compressive stresses, and has good inertness when attacked by external chemical agents.

For example, the ballast 6 may be a mass of concrete, reinforced or otherwise, that is generally cylindrical in shape, and whose periphery is surrounded by a "connecting" shell 7 which may be made of polyvinyl chloride, for example.

It should also be understood that the ballast 6 could be made as a single mass of some other material or that it could be built up of plates or blocks optionally bonded together by any appropriate means. In any event, the ballast 6 is made to constitute a unit mass of compact nature whose center of gravity should be situated on the axial and transverse axes of symmetry.

The body 1 is likewise constituted by molding any appropriate material 8 thereover, and more particularly an elastomer-polymer known under the trade name of Pebax. The overmolding 8 comprises a single piece that completely surrounds the ballast 6, both its periphery and the transverse faces thereof.

The temperature and pressure conditions applying to the molding operation are determined by the material selected for the molding 8 and must be considered as being part of the prior art. However, it should also be observed that the characteristics of the material constituting the ballast 6 should be selected so that the ballast 6 has sufficient mechanical strength in compression, so that it withstands the molding temperature, and so that it withstands any possible chemical attack from the components of the molded material 8.

Figure 3:
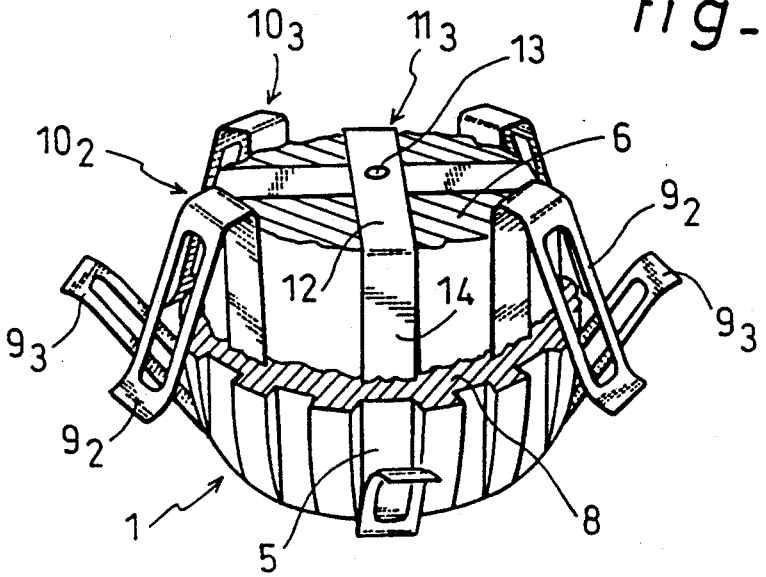
FIG. 3 is a partially cutaway perspective view showing certain component parts of the invention in greater detail.

The body 1 as described above is also associated with resilient tabs 9 which extend outside its periphery 4 from its transverse faces 2 and 3 in radial directions that alternate from one face to the other, as can be seen more particularly in FIGS. 1 and 3. The tabs 9 carry indices (2 or 3) depending on whether they belong to or start from transverse face 2 or transverse face 3.

The tabs $9_2$ and $9_3$ which alternate angularly from one face to the other are also disposed at uniform angular spacing and each of them flares away from the corresponding face towards the transverse midplane P of the body 1 that extends perpendicularly to the axis of symmetry x—x'.

According to the invention, tabs $9_2$ and $9_3$ are constituted by the folded end portions of U-shaped fittings 10 which are organized in the form of two sets $11_2$ and $11_3$. Each set comprises two fittings 10 whose central webs 12 are disposed at right angles for interconnection in their middles. The two fittings constituting each set may be connected together in any suitable manner, e.g. by a stud, a rivet, or the like 13, made of any suitable material selected to avoid the risk of possible corrosion.

The sets $11_2$ and $11_3$ are included in the overmolding 8 within which they may be completely embedded or merely coated in part, for example if the fittings 10 are initially shaped to enclose the ballast 6. In any event, the sets $11_2$ and $11_3$ are disposed so that they interdigitate in opposite directions from opposite ends of the ballast 6 by being offset through 45° in the present example, such that the arms 14 thereof extend successively and alternately from the outside periphery of the ballast 6 in such a manner that the tabs 9 constituted by the folded-back terminal portions thereof satisfy the above-specified conditions concerning their disposition.

In the example shown, it should be assumed that each set 11 comprises two fittings 10 and that the body 6 is associated with two such sets, thereby providing the dummy mine with eight resilient tabs 9. In some circumstances, a different composition could be used by making up each set 11 from three fittings 10, for example.

In conventional manner, the molded and overmolded bodies, the sets of fittings $11_2$ and $11_3$, and the ballast 6 are all disposed in the mold for making the molding 8 in such a manner that the various tabs 9 coincide with positive imprints in the mold for delimiting axially extending recesses 5 in the periphery of the molding 8. These recesses are intended to enable the various tabs 9 to be folded down resiliently so as to facilitate installing, storing, or loading the mines into cylindrical containers or tubes for transport or launching purposes.

As can be seen from the drawings and the above description, an exercise mine of the invention is made in a single operation by forming the molding 8 over the ballast 6 and the sets of fittings $11_2$ and $11_3$ that have previously been disposed in the mold.

As a result, the operations of assembling the various unit parts as occurs in the prior art are eliminated, thereby reducing manufacturing cost. The mine of the invention is mechanically stronger in structure and is less subject to the risk of corrosion, more particularly in the zones where the tabs 9 are connected thereto and where they bend since the tabs are integrally formed with the fittings 10 which are in turn embedded in the body 1, thereby improving the strength of the tabs when subjected to shock on impact with the ground.

The proposed structural embodiment of the invention also makes it possible to reduce the number of component parts since two tabs 9 are constituted by a single fitting 10 merely by folding it.

In order to take account of the thickness of the tabs 9 in the portion where they connect to the arms 14 of the fittings 10, it is advantageous to make the molding 8 in such a manner as to delimit a layer 15 of substantially equal thickness to the tabs 9, if not greater thickness over each of the faces 2 and 3, running from the periphery 4.

The invention is not limited by the example described and shown, and various modifications can be applied thereto without going beyond the ambit of the invention.

I claim:

1. An exercise mine comprising:

an internal ballast portion;

a generally barrel-shaped body including two spaced, generally parallel face portions interconnected by an annular sidewall portion, said body constituting a single piece molded about said ballast portion;

a plurality of groups of generally U-shaped fittings, each fitting including a central web portion embedded in the body and opposed terminal end portions, the web portions of each group being secured together within said body; said groups of fittings disposed on opposite face portions of said body with their respective terminal end portions projecting from said body portion at spaced intervals about the periphery of a face portion located on the side of said body opposite the respective face portion on which the web is disposed and being folded back along and flaring away from said sidewall portion so that the terminal end portions alternately extend in opposite directions in circumferentially spaced relationship about the annular sidewall portion.

2. An exercise mine according to claim 1, wherein said ballast portion has a center of gravity that is centrally located within said body.

* * * * *